US007234375B1

(12) United States Patent
Wang Wu

(10) Patent No.: US 7,234,375 B1
(45) Date of Patent: Jun. 26, 2007

(54) ELECTRIC AIR PRESSURE CORKSCREW

(76) Inventor: Ching Yueh Wang Wu, P.O. Box 90, Tainan City 70499 (TW)

( * ) Notice: Subject to any disclaimer, the term of this patent is extended or adjusted under 35 U.S.C. 154(b) by 0 days.

(21) Appl. No.: 11/378,343

(22) Filed: Mar. 20, 2006

(51) Int. Cl.
*B67B 7/06* (2006.01)

(52) U.S. Cl. ..... 81/3.2; 81/3.48; 81/3.36; 81/3.37

(58) Field of Classification Search ..... 81/3.2, 81/3.48, 3.49, 3.08, 3.36, 3.29, 3.37
See application file for complete search history.

(56) References Cited

U.S. PATENT DOCUMENTS 6,622,595 B1 * 9/2003 Federighi ..... 81/3.48
2003/0230172 A1 * 12/2003 Lee ..... 81/3.2
2004/0244541 A1 * 12/2004 Lin ..... 81/3.2

* cited by examiner

*Primary Examiner*—D. S. Meislin

(57) ABSTRACT

An electric air pressure corkscrew includes an upper shell for containing a motor driving a speed-reducing gear unit, which then turns a rotatable block contained in a lower shell fixed in the upper shell. The rotatable block then pushes an interactive block to reciprocate up and down repeatedly so that a piston in an air cylinder reciprocates up and down to pump air through a needle fixed under the air cylinder and inserted in a cork of a wine bottle and into the interior of the bottle so that the air pressure in the bottle is gradually increased to shove the cork up gradually to separate from the mouth of the bottle. The separated cork can be removed off the needle by turning a rotatable sleeve to move a slide tube and a slide base, easy to handle.

4 Claims, 7 Drawing Sheets

ELECTRIC AIR PRESSURE CORKSCREW

BACKGROUND OF THE INVENTION

1. Field of the Invention

This invention relates to an electric air pressure corkscrew, particularly to one provided with a motor for rotating a speed-reducing gear unit and a rotatable block, which pushes up and down an interactive block so as to moving repeatedly up and down a piston in an air cylinder. Then air is sent through a needle inserted in a cork of a bottle into the interior of the bottle so that the cork may be gradually shoved up by the air pressure in the bottle increased and to be separate from the mouth of the bottle by pressing a push button on the corkscrew to turn on the motor. Then the cork inserted with the needle is separated from the needle by turning a rotatable sleeve to lower down a tubular slide base and a slide tube.

2. Description of the Prior Art

Most bottles for wines and champagne have a cork tightly fixed in the mouth, and the cork has to be removed off the bottle by means of a conventional corkscrew, which includes a grip with a spiral drill to insert in the cork for pulling it off. A conventional corkscrew 1 shown in FIG. 1 is provided with a grip 10 and a spiral drill 11 fixed under the grip 10. In using, the spiral drill 11 is first placed on the upper surface of a cork cap, and the grip 10 is held in a hand and turned again and again, forcing the spiral drill 11 move slowly down into the cork till it reaches a proper depth, and the grip 10 is forcefully pulled up together with the cork to separate from the bottle.

However, the cork is forcefully shoved in the mouth of a bottle for preventing wine or champagne from deteriorating or losing its quality, so it needs quite a great force to pull up the cork off the bottle mouth. Should the depth of the spiral drill 11 of a corkscrew be not enough for pulling off, the cork may break or rift. Or if the spiral drill 11 is screwed too deep, the cork debris removed may drop into the content of the bottle, polluting the content.

SUMMARY OF THE INVENTION

The purpose of the invention is offer an electric air pressure corkscrew for easily and quickly pulling out a cork of a wine or champagne bottle.

The features of the invention are an upper shell for installing a motor and a battery base, a cap with a push button and a switch covering on the upper shell, and a lower shell for containing a fix base for depositing a speed-reducing gear unit connected with a spindle of the motor and having a projecting shaft extending down, a rotatable block fixed under the projecting shaft and having two oppositely spiral surfaces formed in a lower end, a position plate fixed in the fix base and having a multiagonic hole, and an air cylinder fixed under the position plate. The air cylinder has a piston added with an anti-leak gasket in its interior and a multiagonic member fixed on the piston, an interactive block fixed on the multiagonic member. The rotatable block is provided with two oppositely spiral surfaces formed in a lower end, and the interactive block has two oppositely spiral surfaces on an upper surface to correspond to those of the rotatable block. Further a spring is placed under the piston in the air cylinder, and a check valve is fixed under the air cylinder, with a needle with an air hole near a lower tip fixed under the check valve. Further a tubular slide base is fitted around the fix base, having a projecting ridge lengthwise on an inner wall for fitting with a slide groove in the outer wall of the fix base. A slide tube is fixed under the tubular slide base and having a hole in an upper end for a needle to insert through down and two oppositely inclined grooves formed in an outer wall. A rotatable sleeve is fitted around the lower end of the lower shell and having an annular fitting member to fit with the annular projection of the lower shell, and a lower base is fixed under the rotatable sleeve and having two opposite projections on an inner wall to fit movably in the two oppositely inclined grooves of the slide tube.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
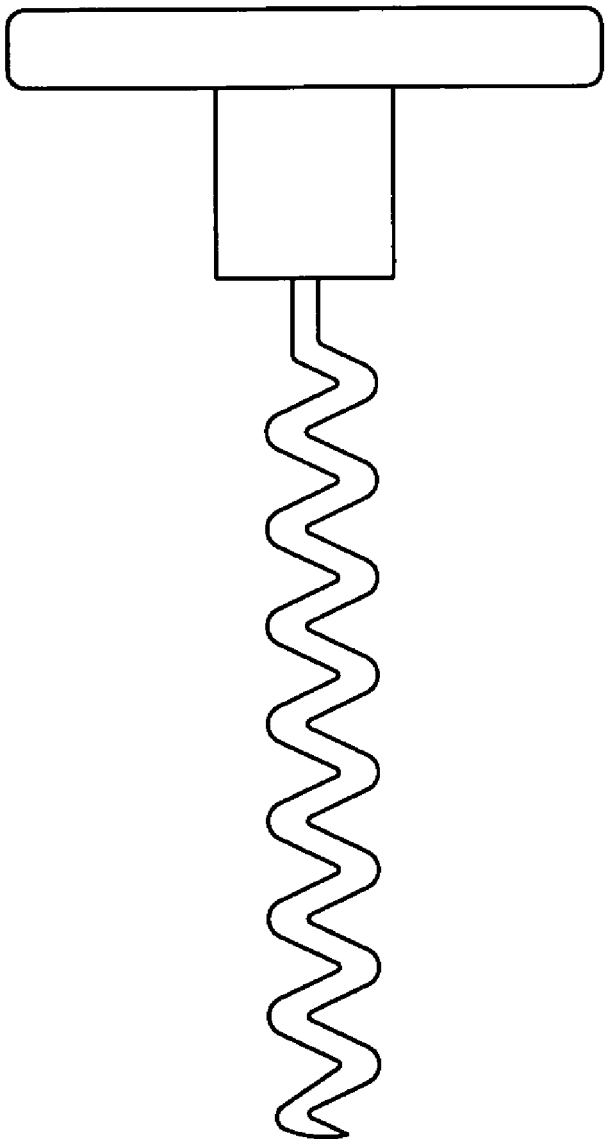
FIG.1 (PRIOR ART)
FIG. 1 is a perspective view of a conventional corkscrew.
Figure 2:
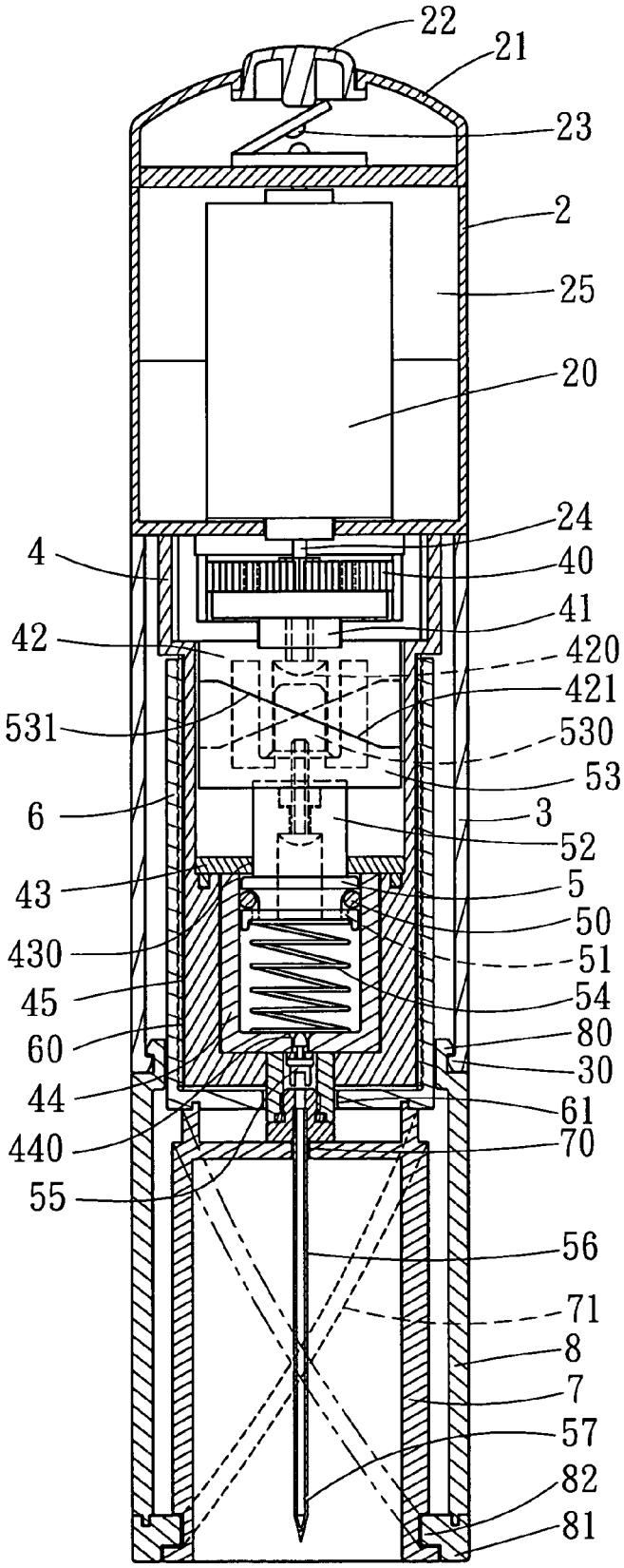
FIG. 2 is a cross-sectional view of an electric air pressure corkscrew in the present invention.
Figure 3:
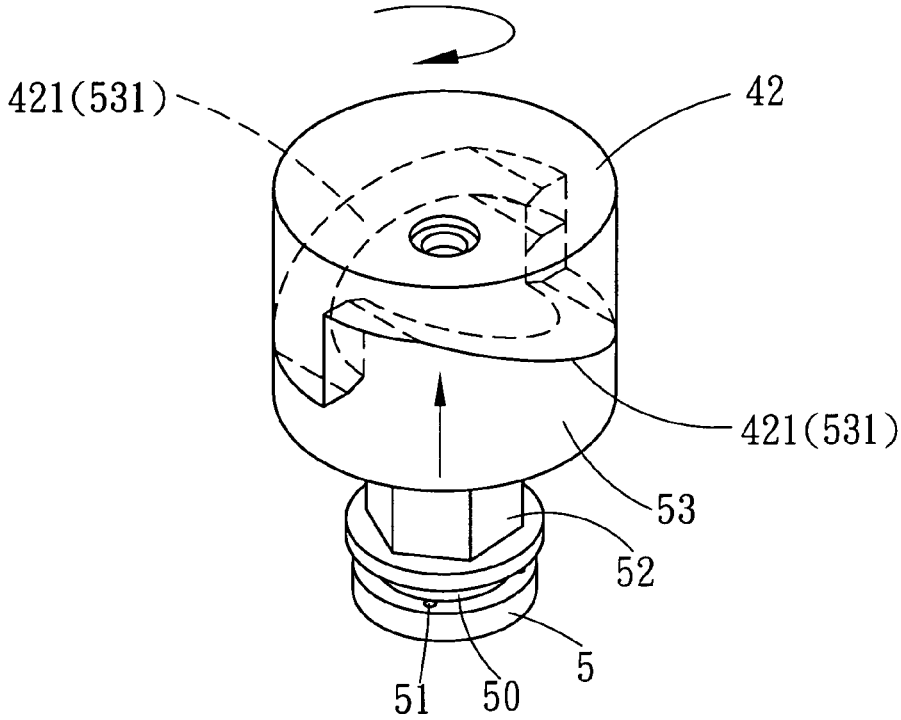
FIG. 3 is a perspective view of a rotatable block combined with an interactive block in the present invention.
Figure 4:
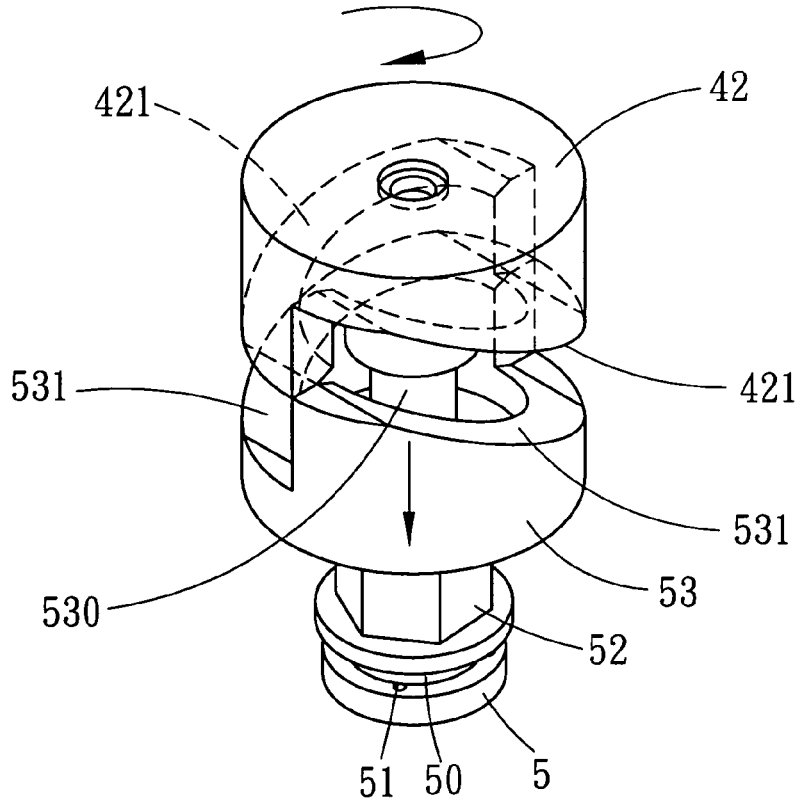
FIG. 4 is a perspective view of the rotatable block combined with the interactive block moved down in the present invention.
Figure 5:
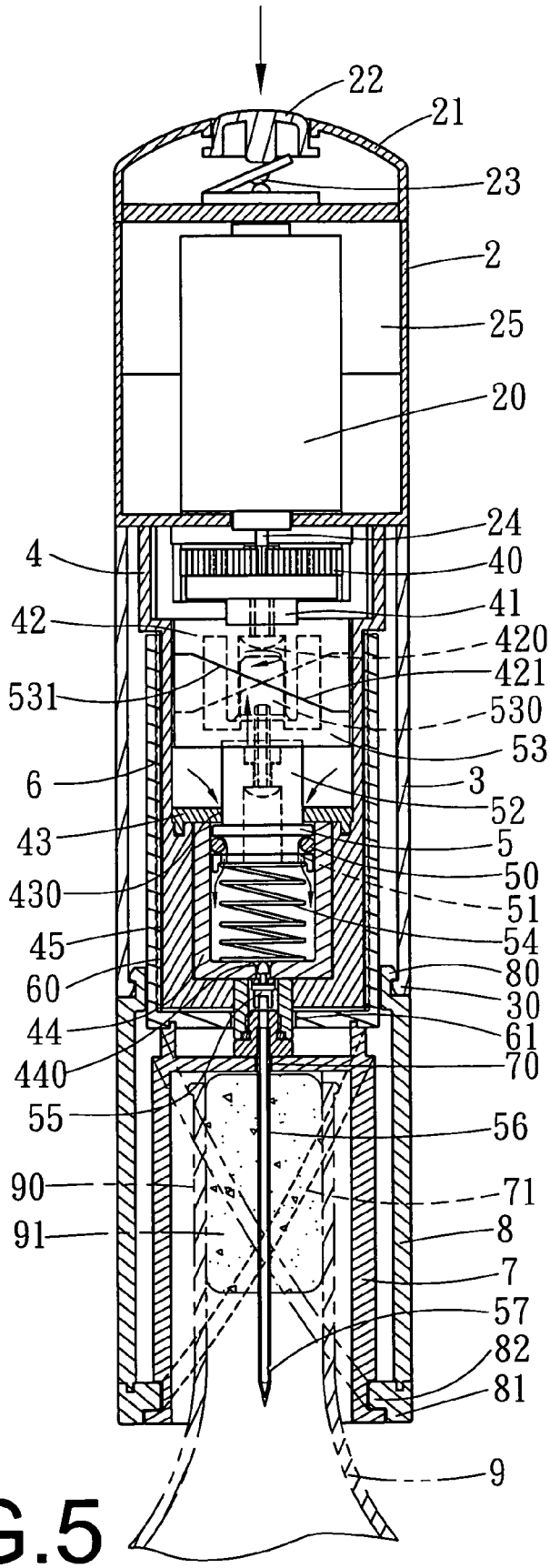
FIG. 5 is a cross-sectional view of a piston moved up for sucking in outer air in the present invention.

A first preferred embodiment of an electric air pressure corkscrew in the present invention, as shown in FIGS. 2, 3 and 4, includes an upper shell 2, a motor 20 fixed in the upper shell 2, a battery base 25 for containing a battery fixed in the upper shell 2, a cap 21 covered on an upper side of the upper shell 2 and having a push button 22 fixed in the center and exposed upward, and a switch 23 fixed under the push button 22 in the cap 21 for turning on and off the motor 20. The electric air pressure corkscrew further includes a lower shell 3 fixed just under the upper shell 2, an annular projection 30 formed in a lower end of the lower shell 3, a fix base 4 fixed in the lower shell 3, a speed-reducing gear unit 40 fixed in the fix base 4, connected with a spindle 24 of the motor 20 and having a projecting shaft 41 extending downward, a rotatable block 42 fixed with a lower end of the projecting shaft 41 and having a hollow 420 and two oppositely spiral surfaces 421 formed on a lower end, as shown in FIGS. 3 and 4. Further, a position plate 43 is fixed in the fix base 4, having a multiagonic hole 430 in the center portion. Further an air cylinder 44 is installed under the position plate 43, having an air hole 440 in the bottom, and a piston 5 fitted movably in its interior, with an anti-leak gasket 50 fixed on the piston 5, which is provided with plural air holes 51 in the bottom. A multiagonic projection 52 is fixed on the piston 5 and extending up in the multiagonic hole 430. Further, an interactive block 53 is fixed on the multiagonic projection 52, having a projection 530 inserted in the hollow 420 of the rotatable block 42. The interactive block 53 has two oppositely spiral surfaces 531 formed on its upper surface to correspond to the two oppositely spiral surfaces 421 of the rotatable block 42.

Further, a spring 54 is placed under the piston 5, a check valve 55 is placed under the air cylinder 44, and a needle 56 is provided under the check valve 55, having a center lengthwise hole and an air hole 57 communicating with the center lengthwise hole near its lower tip. Then a tubular slide base 6 is fitted around a larger lower portion of the fix base 4, having a projecting strip 60 lengthwise on an inner wall to fit with the slide groove 45 of the fix base 4, and a hole 61 in the bottom wall for the check valve 55 to insert therein. Further, a slide tube 7 is fixed under the tubular slide base 6, having a hole 70 in an upper wall for the needle 56 to pass through down in the interior of the slide tube 7, and two oppositely inclined grooves 71 extending to cross each other on an outer wall. Further a rotatable sleeve 8 is positioned under the lower shell 3, having an annular recess 80 in an upper end to fit with the annular projection 30 of the lower shell 3, and a bottom base 81 is fitted with the lower end of the rotatable sleeve 8, having two opposite projections 82 on an inner wall to fit movably with the two inclined grooves 71 of the slide member 7.

In using, referring to FIGS. 2, 3, 4, 5 and 6, the electric air pressure corkscrew is placed on the mouth 90 of a wine bottle 9, with the needle 56 inserted through a cork 91 in the mouth 90 into the interior of the bottle 9. Then the push button 22 of the cap 22 is pressed to turn on the switch 23 so that the motor 20 may begin to operate. Then the spindle 24 of the motor 20 rotates the speed-reducing gear unit 40, which then turns the rotatable block 42 under the protruding shaft 41 so that the interactive block 53 may be pushed down by means of the two oppositely spiral surfaces 421 of the rotatable block 42 contacting the two spiral surfaced 531 of the interactive block 53. Then the piston 5 is pushed down by the interactive block 53, compressing the spring 54 down. During moving down of the piston 5, the anti-leak gasket 50 closely rests against the inner wall of the air cylinder 44, preventing the air in the air cylinder 44 from leaking upward, and forcing the air to flow through the air hole 440 to push off the check valve 55. Then the air flows through the air hole 57 of the needle 56 into the interior of the bottle 9. Every time when the rotatable block 42 turns for 180 degrees, the spiral surfaces 421 of the rotatably block 42 may separate from the spiral surfaces 531 of the interactive block 53, permitting the spring 54 recover the elasticity and push the piston 5 together with the interactive block 53 back upward so that the spiral surfaces 531 of the interactive block 53 may again rest against the spiral surfaces 421 of the rotatable block 42. When the piston 5 moves up, the anti-leak gasket 50 moves down, not contacting the inner wall of the air cylinder 44 to permit the air flow in the air cylinder 44 through the air hole 51, In this way, the reciprocating up-and-down movement of the interactive block 53 by the rotation of the rotatable block 42 together with the up-and-down movement of the piston 5 in the air cylinder 44 sends outer air in the interior of a wine bottle 9 so that the air pressure in the bottle 9 may gradually be increased, forcing the cork 91 slowly and gradually shift up to separate from the mouth 91 of the bottle 9, without need of an pressured air can, saving the expense for it.

Figure 6:
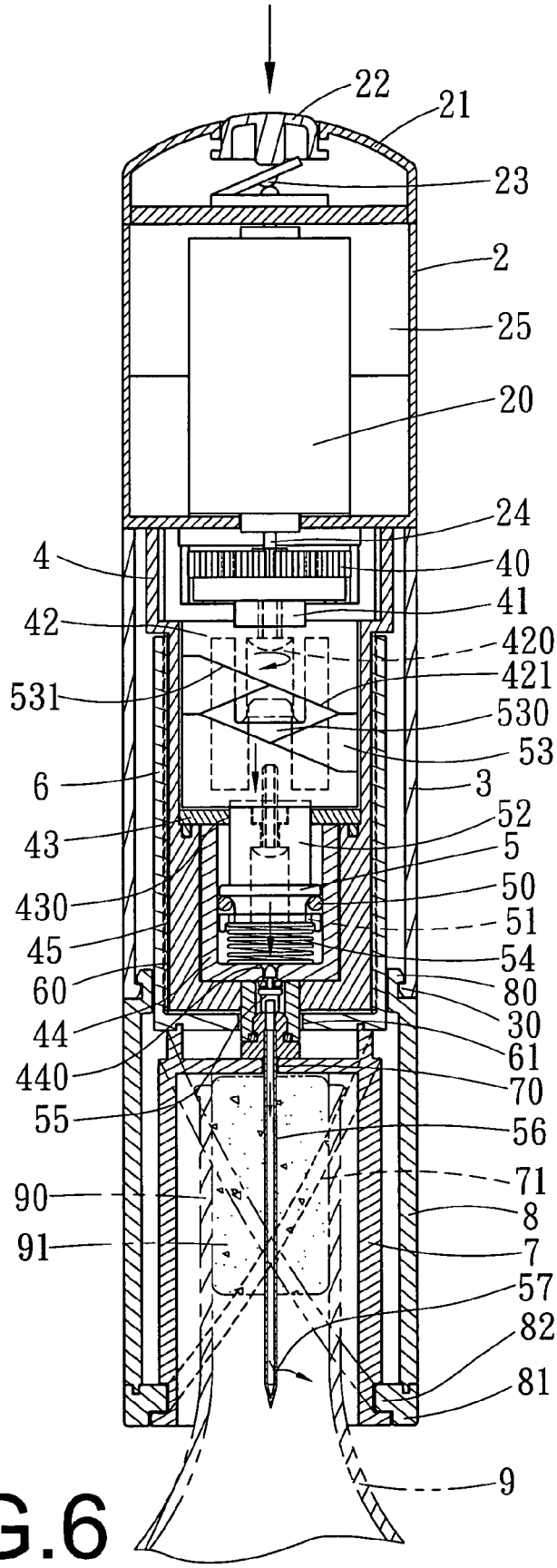
FIG. 6 is a cross-sectional view of the piston moved down for forcing air into a bottle in the present invention.
Figure 7:
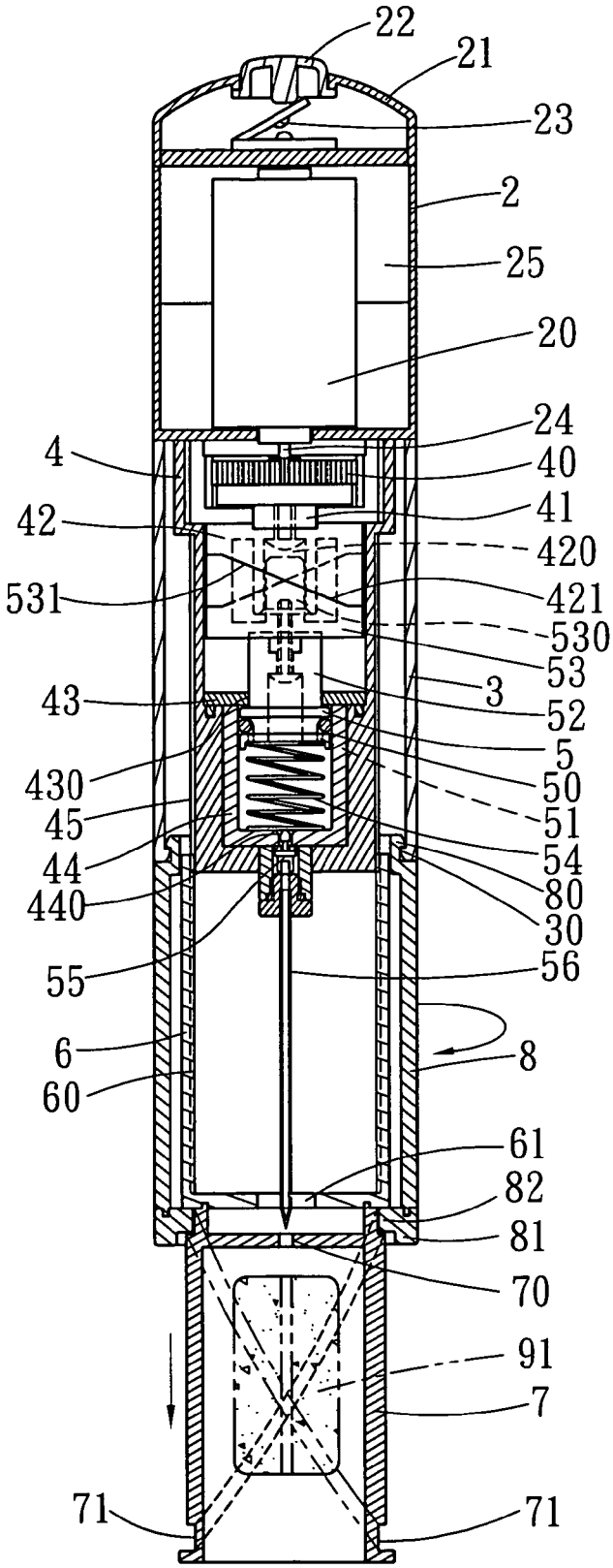
FIG. 7 is a cross-sectional view of the cork removed off a bottle by the electric air pressure corkscrew in the present invention.

If the separated cork 91 inserted with the needle 56 and remained in the slide tube 7 is wanted to be taken off the needle 56 after the cork 91 is removed off the mouth 91 of the bottle 9, referring to FIGS. 6 and 7, the rotatable sleeve 8 is turned, letting the two projections 82 slide in the slide groove 71, and the slide tube 7 may move down gradually by sliding movement of the projections 82, so the tubular slide base 6 also slides down, with the needle 56 kept immovable. Then the cork 91 may gradually be pushed down by the slide tube 7 to separate from the needle 56 and finally drop down from the interior of the slide tube 7. Then the rotatable sleeve 8 is turned in the counter direction, pushing up the slide tube 7 and the tubular slide base 6 back to the original position in the rotatable sleeve 8, and the needle 56 is remained in the slide tube 7, finishing taking off action of the cork 91 with convenience.

Figure 8:
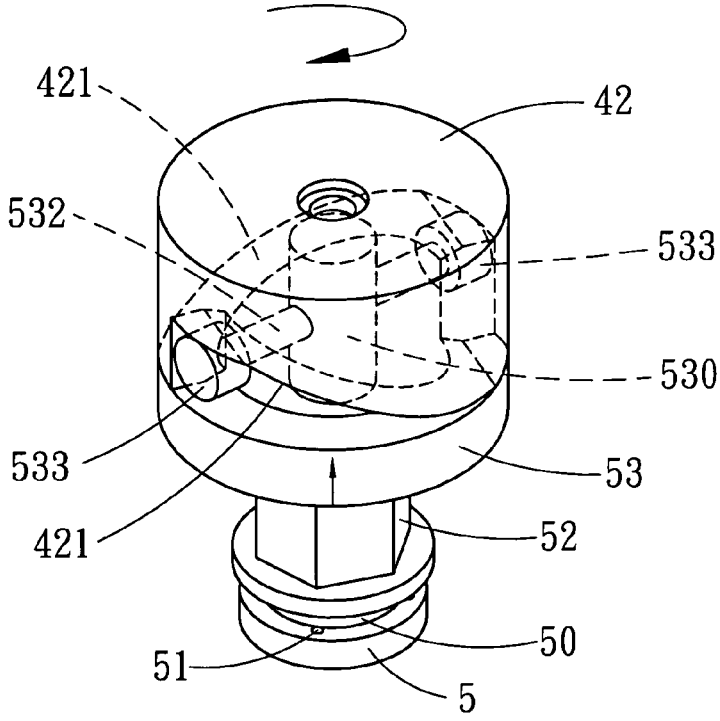
FIG. 8 is a perspective view of the piston moved up in a second embodiment of an electric air pressure corkscrew in the present invention; and, FIG. 9 is a perspective view of the piston moved down in the second embodiment of an electric air pressure corkscrew in the present invention.
Figure 9:
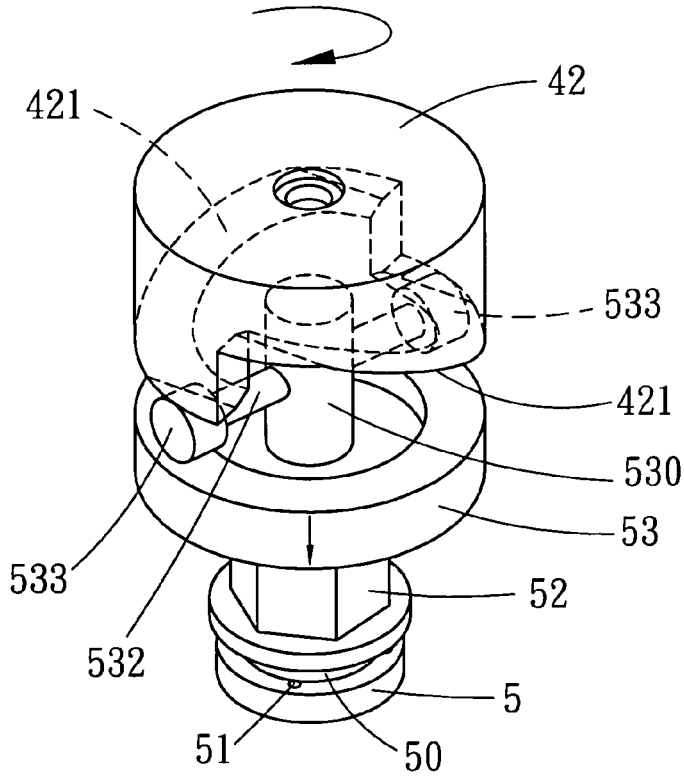

Next, a second preferred embodiment of the electric air pressure corkscrew in the invention is shown in FIGS. 8 and 9, having almost the same structure, so only the different points are to be described. The second preferred embodiment has a piston 5 fixed with an anti-leak gasket 50, and the piston 5 has plural air holes 51 in the bottom. Further a multiagonic member 52 is fixed on the piston 5, extending in the multiagonic hole 430 of the position plate 43, and an interactive block 53 is fixed on the multiagonic member 52, having a post 530 vertically standing upward and extending in the hollow 420 of the rotatable block 42, and a rod 532 fitting laterally through the post 523 and having two ends respectively fixed with a roller 533 resting on each of the spiral surfaces 421 of the rotatable block 42.

In using the second embodiment, the spindle 24 of the motor 20 drives the speed-reducing gear units 40 to rotate, and then the gear units 40 turns the rotatable block 42 so that the spiral surfaces 421 of the rotatable block 42 resting on the rollers 533 may push down the interactive block 53 and the piston 52 together, and with the spring 54 compressed down. Every time when the rotatable block 42 turns for 180 degrees, the rollers 533 of the interactive block 53 reach the lowest point, so the spring 54 may recover its elasticity to push up the piston 5 and the interactive block 53 together, letting the interactive block 53 reciprocate up and down repeatedly. Thus the piston 5 also reciprocates in the air cylinder 44 for pumping air through the needle 56 in a bottle 9 for shoving a cork 91 of the bottle 9 gradually upward to separate from the mouth of the bottle 9. Therefore, the second preferred embodiment has the same function as the first one.

While the preferred embodiments of the invention have been described above, it will be recognized and understood that various modifications may be made therein and the appended claims are intended to cover all such modifications that may fall within the spirit and scope of the invention.

What is claimed is:

1. An electric air pressure corkscrew comprising:

an upper shell, a motor and a battery base deposited in said upper shell, a cap covered on an upper side of said upper shell, said cap having a push button fixed in its center portion to expose upward, an electric switch fixed under and pushed by said push button;

a lower shell fixed under said upper shell and having an annular projection formed in a lower end, a fix base fixed in said lower shell, a speed-reducing gear unit fixed in said fix base, said speed-reducing gear unit connected to a spindle of said motor and having a projecting shaft extending downward;

a rotatable block fixed under said projecting shaft and having two oppositely spiral surfaces formed in a lower end, a positioning plate fixed in said fix base and having a multiagonic hole;

an air cylinder fixed under said position plate and having plural air holes in a lower end, a piston fitted movably in an interior of said air cylinder, said piston having an anti-leak gasket fixed thereon and plural air holes in a lower end, a multiagonic member fixed on said piston and extending in said multiagonic hole of said position plate, an interactive block fixed on said multiagonic member and capable of corresponding to said two oppositely spiral surfaces of said rotatable block;

a spring placed under said piston;

a check valve deposited under said air cylinder;

a needle placed under said check valve and having a center lengthwise hole and an air hole near its lower tip and communicating with said center lengthwise hole;

a tubular slide base fitted around said fix base and having a projecting strip lengthwise on an inner wall to fit with a slide groove provided in an outer wall of said fix base;

a slide tube fixed under said slide base and having a hole in an upper end for said needle to insert through down, said slide tube further having two oppositely inclined slide grooves on an outer wall;

a rotatable sleeve fitted around a lower end of said lower shell and having annular fitting member on an upper end for fitting with said annular projection of said lower shell; and, a bottom base fixed under said rotatable sleeve and having two opposite projections on an inner wall to fit in said two oppositely inclined slide grooves of said slide tube.

2. The electric air pressure corkscrew as claimed in claim 1, wherein said interactive block of said piston has two oppositely spiral surfaces on an upper surface thereof capable of corresponding to said two oppositely spiral surfaces of said rotatable block.

3. The electric air pressure corkscrew as claimed in claim 1, wherein a post is provided to stand on said interactive block, and a rod is provided to laterally inserted diametrically through said post, having two ends fixed respectively with a roller to rest on said two oppositely spiral surfaces of said rotatable block.

4. The electric air pressure corkscrew as claimed in claim 1, wherein a post is provided to stand on said interactive block, and said post inserts in said hollow of said rotatable block.

* * * * *